United States Patent [19]

Schladitz

[11] 4,019,021

[45] Apr. 19, 1977

[54] ELECTRIC RESISTANCE FLUID HEATING APPARATUS

[75] Inventor: Hermann J. Schladitz, Munich, Germany

[73] Assignee: Schladitz-Whiskers, A.G., Zug, Switzerland

[22] Filed: June 6, 1974

[21] Appl. No.: 476,946

Related U.S. Application Data

[60] Division of Ser. No. 23,090, April 6, 1970, Pat. No. 3,833,791, which is a continuation of Ser. No. 474,797, July 26, 1965, abandoned.

[30] Foreign Application Priority Data

July 28, 1964 Switzerland ..... 9872/64

[52] U.S. Cl. ..... 219/381; 219/10.49; 219/10.51; 219/307; 219/338; 219/374; 338/54; 338/223

[51] Int. Cl.[2] ..... H05B 3/12; F24H 1/10; F24H 3/04

[58] Field of Search ..... 219/307, 300, 319, 381, 219/374, 375, 382, 306, 338, 10.51, 10.49, 10.65; 338/223–225, 54, 55

[56] References Cited

UNITED STATES PATENTS

| | | | |
|---|---|---|---|
| 795,956 | 8/1905 | Byrmes | 219/306 |
| 1,277,657 | 9/1918 | Smith | 219/307 UX |
| 2,560,220 | 7/1951 | Graziano | 219/381 UX |
| 2,700,722 | 1/1955 | Gurley | 219/338 X |
| 2,884,319 | 4/1959 | Fabian et al. | 219/381 UX |
| 3,032,635 | 5/1962 | Kraft | 219/381 UX |
| 3,161,501 | 12/1964 | Southam | 219/381 UX |
| 3,165,826 | 1/1965 | Bentov | 219/381 UX |
| 3,833,791 | 9/1974 | Schladitz | 219/307 X |

FOREIGN PATENTS OR APPLICATIONS

| | | | |
|---|---|---|---|
| 531,112 | 12/1940 | United Kingdom | 219/381 |

*Primary Examiner*—A. Bartis
*Attorney, Agent, or Firm*—Craig and Antonelli

[57] ABSTRACT

A resistance heating apparatus for rapidly heating a liquid or gas to a desired temperature includes a porous mat of fine electrically-conductive elongated elements selected from the group consisting of metal coated non-metal whiskers and polycrystalline metal whiskers electrically connected at their points of contact by metallization from the gaseous phase or by electron beam welding so as to be electrically conductive. The porous mat is disposed in and substantially fills all of the length of an electrically non-conductive tubular structure having an inlet opening at one end and a discharge opening at the opposite end. The tubular structure may be conical in shape with the inlet end being larger than the outlet end. Heating current may be supplied directly to the mat by electrodes connected thereto or the current may be induced therein from an induction means around the tubular structure.

15 Claims, 5 Drawing Figures

ELECTRIC RESISTANCE FLUID HEATING APPARATUS

SUMMARY OF THE INVENTION

This application is a Divisional application of application Ser. No. 23,090, filed Apr. 6, 1970, now U.S. Pat. No. 3,833,791, dated Sept. 3, 1974 which in turn was a streamline continuation of abandoned application Ser. No. 474,797, filed July 26, 1965.

The present invention related to a method and apparatus for rapidly heating gases, liquids, vapors and aerosols to a desired temperature by electric resistance heating.

Already known in the art is a large number of electric resistance heaters, also referred to at times as heat exchangers, which give off to gases or liquids joulean heat, produced by the electric current, either directly by heat conduction or indirectly by convection heat or heat radiation, or by a mixed heat transfer of these different types. A portion of these known electric resistance heaters is electrically insulated from the medium to be heated, for example, the generally known immersion heaters. Other resistance heaters are self-supporting and freely exposed and without protection of their metallic surface, for example, asbestos heating grills or self-supporting, exposed heating coils of electric furnaces or ovens.

These known resistance heaters do not act directly on the entire volume of the medium to be heated, but only upon the portion thereof which is present in the immediate vicinity of the resistance heater, whereas the medium in its entirety is then heated by heat convection to the desired temperature within a certain amount of time. In order to heat the medium to be heated to the desired temperature in as short a time as possible and in order to compensate for heat losses, the surface tempreature of the resistance heater must be higher than the temperature which the medium to be heated is to adopt utilimately.

This known manner of heating gases or liquids has the disadvantage that, in order to impart to each space portion of the medium to be heated the required amount of heat within a short period of time, excessively long paths and therewith excessively long periods of time are necessitated. This is a direct consequence of the fact that of the total volume of the medium to be heated only a relatively small proportion thereof will come into direct contact with the resistance heater.

The process and apparatus according to the present invention also makes use of a heat exchanger in the form of a resistance heater which, however, enables to heat the entire volume of the medium almost simultaneously by virtue of the fact that an extremely large surface is offered to the gaseous medium by the resistance heater. The process and apparatus according to the present invention for the rapid heating of gases, liquids, vapors and aerosols to a desired temperature essentially consists in that the material to be treated is passed through an electric resistance heater which comprises as the structural elements thereof electrically conductive, mutually interlocked hair-like elements, needles or rodlets, preferably so-called whiskers, and whose structural elements offer to the material to be treated per cubic centimeter thereof a surface of at least 800 square centimeters.

The resistance heater thus consists of extremely thin metal wires metal hair-like elements or needles, with which the ratio of diameter to length its approximately between 1:10 to 1:10,000 and which are matted with each other or mutually joined with each other in any suitable known manner so that a skeleton with fine pores and having an extremely large surface comes into existence. If the skeleton consists, for example, of small rods having a diameter of 1 micron and if one assumes as an example a specific weight of the filament skeleton of 0.8, then one cubic centimeter of the volume of this skeleton has a total surface of 3600 $cm^2$. Accordingly, there is offered to the medium to be heated which is introduced into the pores of 1 ccm of the heater exchanger in accordance with the present invention, a heat-emitting surface of 3600 $cm^2$ so that the medium to be heated can be heated almost instantaneously—as compared to other ways of heating thereof. A very large heat-emissive surface thus confronts or faces directly each smallest volume portion of the liquid or gaseous medium which is present in one of the pores of the heating element in accordance with the present invention which surface is able to give off its heat to the medium over the shortest path by radiation and heat conduction. In order to point out more clearly the unusually rapid heat transfer from the resistance heater according to the present invention to the medium to be heated, several examples will be described hereinafter which relate to the respective ratio of the surface of the heat exchanger to the volume present in its pores of the medium to be heated.

While in the known heat exchangers for heating liquids, i.e., for example, in an immersion heater, in an electric pot or in a flow heater pipe, a heat-emitting surface on the average of approximately 0.02 to 0.5 $cm^2$ is coordinated to each ccm of liquid, the corresponding value for each ccm—according to the method and apparatus according to the present invention—amounts to 130 $cm^2$ with filaments of 20$\mu$m, 200 $cm^2$ with filaments of 5$\mu$m and 1000 $cm^2$ with filaments of 1$\mu$m, in diameter.

The increase of the surface, coordinated to each volume unit of the resistance heater with the decreasing diameter of the metal filaments or wires is a result of the fact that the total surface of a wire-like body below a certain diameter will increase to an extraordinary extent so that, with the same total wire weight, a wire with a 10$\mu$m diameter already possesses the 40-fold surface of a wire of 100$\mu$m diameter, with a 1$\mu$m diameter the 100-fold and with a 0.1$\mu$m diameter the 1000-fold surface.

If the liquid or gaseous medium to be heated is intended to flow through the resistance heater, then it is advantageous to keep the rate of flow of the medium to be heated as high as possible. This means that the size of the pores of the resistance heater must be as large or coarse as possible so as to reduce the flow resistance, For this reason, the present invention utilizes for the structure of the resistance heater, preferably the finest hair-like elements, needles or rodlets and preferably so-called whiskers. In contrast to the construction of a resistance heater from grain-like individual elements, such a porous skeleton made of hair-like elements, needles or rodlets has, apart from the aforementioned extremely large surface, also substantially larger pores and thus a lower flow resistance. Nevertheless, one still has to reckon in connection with a rate of flow of the liquid or gaseous medium through the porous skeleton of the resistance heater with high flow resistances so that, in the course of overcoming the same, relatively large forces may act on the individual structural element. For this reason, the structural elements of the resistance heater according to the present invention consist preferably of a material having a particularly great rigidity, preferably of hair-like elements, needles or rodlets with a crystallite size that is considerably smaller than the filament diamter itself, or of so-called metal whiskers which are grown from the gaseous phase and which have either a polycrystalline or a monocrystalline character, whereby the latter—despite the monocrystalline character thereof—obtain their high strengh by a minimum of dislocations, while the former do so with a maximum of dislocations. According to the present invention, the structural elements of the resistance heater may also be metallized non-conductors, for example, metallized highly resistant and notch-free glass fibers, quartz fibers or organic fibers, or also metallized, non-metallic whiskers having an above-average rigidity, for example, monocrystal-whiskers of aluminum oxide or the like. The individual structural elements may also consist of alloys instead of metals, or of metals and alloys, or of metallized non-conductors and metals, or of alloys and metallized non-conductors.

The structural elements may also be blade- or band-shaped. With particular advantage, the structural elements may also be hollow for the purpose of increasing the surface. Such hollow structural elements are obtained, for example, by metallizing the finest hair-like elements, needles, rodlets, foils or bands consisting of organic substances and by dissolving out the organic substance so that the metal shell or skin is left. For heating conductive liquid media, the structural elements of the resistance heater of the present invention are provided with a very thin insulating coating essentially consisting of lacquer, plastic material, oxide or electrophoretically deposited insulators of very fine grain size. When higher specific pressures act on the liquid or gaseous medium flowing through the heat exchanger, such resistance heaters are used with particular advantage whose structural elements are mutually grown together or coalesced, soldered, welded, or sintered together. The bonding, cementing, soldering, welding, sintering or growing together of the hair-like, needle-like, or rod-shaped structural elements may be achieved by a number of known conventional measures and is effected after the porosity has been pre-established by a corresponding filling and compression of the structural elements. As a non-limitative example of this mechanical stabilization of the skeletons the following may be mentioned:

Joining or connections of the structural elements at the points of contact thereof by metallization from the gaseous phase, welding by brief local melting with the aid of coherently bunched light rays, by electron beam welding, by ultrasonic welding, further by galvanic separation of metals, by recombination heat of atoms, such as, for example, hydrogen atoms, and by similar measures which are applicable dependent on the shape and material of the structural elements of the resistance heater.

In accordance with the present invention, the mechanical stability of the resistance heater may be further increased in that the structural elements thereof are grown together with, cemented, soldered, welded, or sintered to the walls of the container or casing receiving the resistance heater. This measure prevents, at higher pressures of the medium flowing through the resistance heater, the tearing open of a path of lower flow resistance along the enclosing wall. A further step consists in that the resistance heater is more or less conically tapered, and more particularly in the direction of flow of the medium to be heated. Owing to this measure, the pressure rigidity of the resistance heater is increased with respect to the flowing medium. Furthermore, an intentionally non-uniform heating of the resistance heater is attained thereby in that the relatively wider part of the resistance heater is heated less by reason of its smaller resistance than the narrower part so that the medium to be heated, during its travel toward the narrow part of the column, is heated progressively more intensely. In this manner, the medium is initially preheated in the wider part of the resistance heater in order to be heated subsequently to the final temperature at the apex, i.e., in the narrower part.

This is of significance for such media which because of the danger of the chemical decomposition, can withstand only a heating of an extremely short duration, for example, for hydrocarbons with which a cracking process would set in at higher temperatures within a short period of time.

The conical configuration of the resistance heater may be varied in many different ways in that, for example, one changes the angle of the cone or in that the cone is constructed hollow, or in that one uses a heat-conducting disk or plate through which the medium to be heated flows from the outer edge toward the inside of the disk to leave the same in the center thereof.

The resistance heater can be connected thereby directly with a source of current in any known manner whereby it is of particular advantage to construct the current connections also highly porous. The resistance heater may, however, also be an induction heater, which involves the particular advantage that the contact means may be dispensed with so that, in the operation of the method and apparatus of the present invention, there exists the possibility of eliminating heat losses due to heat conduction by way of the current supply which is essential particularly in the case when the resistance heater is intended to assume high temperatures. The application of the present invention is concerned with gaseous and liquid media in general, but is also applicable with other states of aggregation of matter or material which is capable of being transported through the pores of the heat exchanger, for example, vapors, mists, aerosols, gels, suspensions and suspended particles in liquids. It is also within the scope of the present invention to utilize the heating of the medium or media treated together in the heat exchanger for the initiation and/or realization of other pyysical or chemical reactions which are initiated or accelerated by the heating operation, whereby a catalytic effectiveness of the material of the heat exchanger is included either additionally or exclusively.

Finally, it is also within the purview of the present invention to use the heating of a medium by means of the heat exchanger according to the present invention for the selective physical or chemical reactions, for example, for the fractional distillation, for initiating a chemical partial reaction between constituents of the heated medium, for changing the diffusion velocity of gases, or for the ionization of gases at high temperatures of the heat conductor.

Accordingly, it is an object of the present invention to provide a method and apparatus for rapidly heating fluids and the like which obviate the aforementioned shortcomings and drawbacks encountered with the prior art.

It is another object of the present invention to provide a method and apparatus for rapidly heating liquid and gaseous media which heats directly substantially the entire volume of the medium to be heated.

Another object of the present invention resides in the provision of a resistance heater of the type described above which minimizes heating losses and permits heating of the medium to be heated in a relatively short time.

Still a further object of the present invention resides in a resistance heater in which the entire volume of the medium to be heated is heated nearly uniformly and which presents a skeleton structure having fine pores with an extraordinary large surface.

Another object of the present invention resides in the provision of a resistance heater which permits an almost instananeous heating of the medium to be heated.

A further object of the present invention resides in the provision of a resistance heater offering a large heating surface, yet having substantial rigidity sufficient to withstand all pressures that may be expected to occur in the system.

These and further objects, features and advantages of the present invention will become more obvious from the following description when taken in connection with the accompanying drawing which shows for purposes of illustration only several embodiments in accordance with the present invention and wherein.

Figure 2:
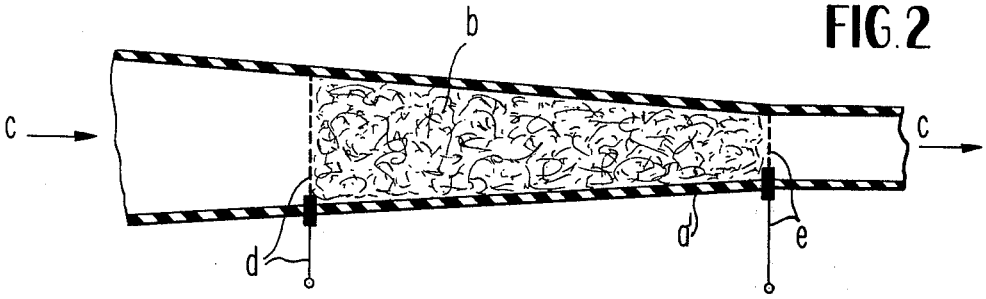
FIG. 2 is a cross sectional view through a modified embodiment of a resistance heater in accordance with the present invention, in which the resistance heater is of conical construction.
Figure 3:
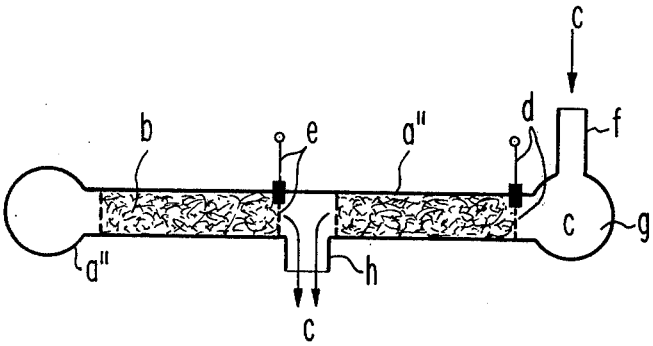
Figure 4:
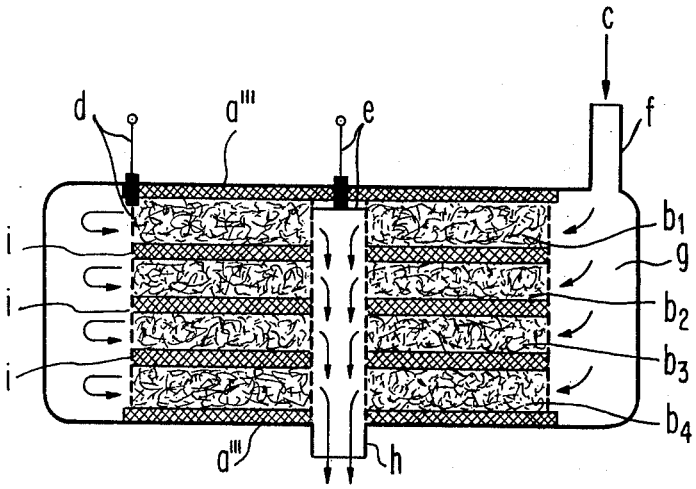
Figure 2A:
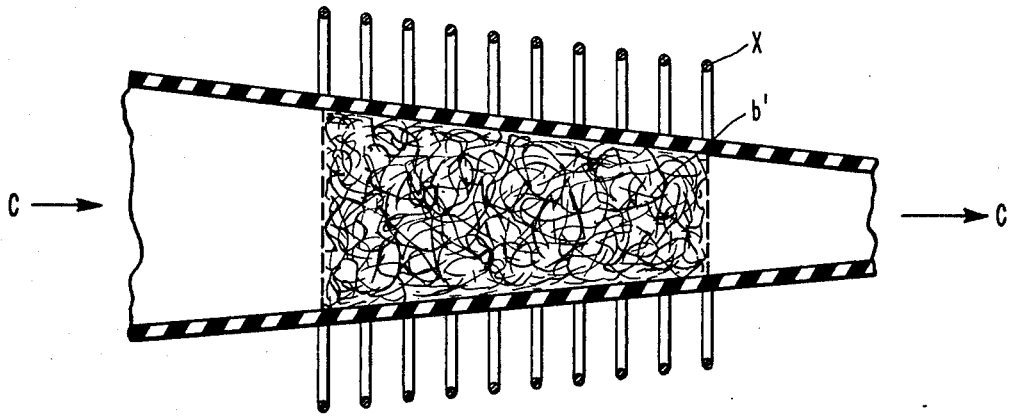

FIG. 2*a* is a cross-sectional view through a modified embodiment of a resistance heater similar to that shown in FIG. 2 but wherein the heater is inductively heated;

FIG. 3 is a cross sectional view through a still further modified embodiment in accordance with the present invention illustrating an annular resistance heater in which the medium to be heated flows from the outside toward the inside; and FIG. 4 is a cross sectional view through a multi-section resistance heater in accordance with the present invention combining some of the features of other embodiments.

The most simple form of an apparatus for carrying out the method according to the present invention is a cylindrical tubular member or pipe within which is accommodated the resistance heater.

Figure 1:
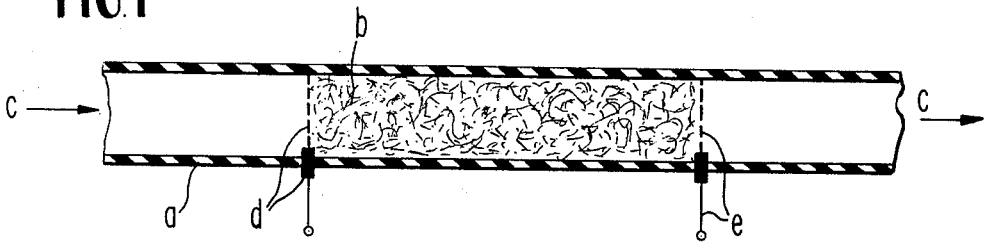
FIG. 1 is a cross sectional view through a first embodiment of a resistance heater in accordance with the present invention.

FIG. 1 illustrates this arrangement, in which reference character *a* designates a pipe or tubular element made of nonconductive material, reference character *b* represents the column of the porous conductive heat-conductor, reference character *c* indicates the medium flowing through the heat exchanger, and reference characters *d* and *e* designate electrodes which are positioned with a secure contact at the ends of the porous heat exchanger and which supply and carry off the heating current. The arrows indicate the direction of flow of the medium to be heated.

FIG. 2 shows another embodiment of an apparatus in accordance with the present invention, in which the resistance heater has a conical configuration. Enclosed within a conical insulating tube a′ is the porous heat exchanger *b* through which flows the medium *c* to be heated. The electrodes *d* and *e* which are pervious or permeable to the flow medium to be heated are secured with good contact to the heat exchanger cone *b* at both ends thereof.

FIG. 2*a* illustrates an embodiment similar to FIG. 2 except that the elongated elements *b′* are heated by induced current by induction heating means *x*.

The medium to be heated generally flows through the porous heat exchanger *b*, heated by resistance heating, from the wider to the narrower part of the cone. The temperature attained with the resistance heating in the proous heat exchanger depends on its cross section, and therewith on the electric conductivity thereof so that, depending upon the angle which the heat exchanger cone posesses, a more or less great temperature drop or gradient exists between the base and the apex thereof. Accordingly, the medium flowing through the heat exchanger cone is heated less at the base and is heated more strongly at the apex thereof. Simultaneously, also the flow velocity of the medium increases from the base to the apex of the heat exchanger cone so that the medium flows more rapidly through the heat exchanger cone in the place of higher temperature.

A further embodiment of the present invention is illustrated in FIG. 3 in which reference character a″ designates a flat cylinder which is larger in the diameter thereof than the disk-shaped porous heat exchanger *b* to form a peripheral inlet channel *g* connected with the supply conduit *f* so that the medium *c* flowing through the heat exchanger *b* flows through the heat exchanger *b* from the outer rim thereof toward the center and leaves the same through the central discharge conduit *h*. The annular electrodes *d* and *e*, which are permeable or pervious to the medium to be heated, are connected with good electrical contact in any conventional manner with the heat exchange disk *b*. As with the embodiment of the conical heat exchanger according to FIG. 2, the heat exchanger disk *b* according to FIG. 3 is heated, under resistance-heating, to a lesser degree at the periphery thereof than in the central part thereof so that also in this arrangement the temperature of the heat exchanger disk and therewith of the medium flowing therethrough, increases from the outside toward the inside thereof.

The embodiments of installations according to FIGS. 1, 2 and 3 may also be varied in that the same or different embodiments are combined with one another. An embodiment, wherein several of the heat exchanger according to FIG. 3 constructed in a disk-shaped manner are provided for the purpose of achieving a greater quantity of rate of flow, is shown, for example, in FIG. 4. Reference characters $b_1$, $b_2$, $b_3$ and $b_4$ designate therein the individual heat exchanger disks through which flows simultaneously the medium supplied through inlet conduit *f* and common annular feed changer *g* to be again discharged simultaneously in the central bore *h* of the individual disks. The porous electrodes *d* and *e* are thereby common to all of the used heat exchanger disks. The heat exchanger disks $b_1$, $b_2$, $b_3$ and $b_4$ are arranged between flat cylinders *a‴* having several stages with interposed induction coils *i* to furnish additional heat. However, it is understood that in this, as well as in the other embodiments, induction heating may be used additionally to resistance-heating caused by a direct connection with the current supply or in lieu of such direct connection with the current supply.

While I have shown and described several embodiments in accordance with the present invention, it is understood that the same is not limited thereto but is susceptible of numerous changes and modifications as known to a person skilled in the art and I therefore do not wish to be limited to the details shown and described herein but intend to cover all such changes and modifications as are encompassed by the scope of the appended claims.

I claim:

1. A resistance heater for rapidly heating a fluid to a desired temperature, comprising an electric resistance element including a porous mat of fine, electrically-conductive, elongated elements connected together so as to be electrically conductive, said elongated elements being selected from the group consisting of metalcoated non-metal whiskers and polycrystalline metal whiskers, power means for supplying electric energy to said resistance element, and a non-conductive tubular structure accommodating the resistance element therein so that substantially all of the fluid flows through said porous mat, said porous mat being disposed so as to substantially fill a portion of the length of said tubular structure, said tubular structure having at one end an opening for admission of the fluid to be heated and at the opposite end an opening for discharge of the heated fluid, wherein said elongated elements are connected at the contact points thereof by metalization from the gaseous phase.

2. A resistance heater according to claim 1, wherein said tubular structure is conical and the resistance element has a conforming conical shape with the admission opening being at the end having the larger transverse cross-sectional area.

3. A resistance heater according to claim 2, wherein said mat is securely connected at the inner wall of said tubular structure.

4. A resistance heater according to claim 1, wherein said mat is securely connected at the inner wall of said tubular structure.

5. A resistance heater according to claim 1, wherein said power means comprises means for directly supplying current to said mat and includes electrode means electrically connected to the mat.

6. A resistance heater according to claim 5, wherein said tubular structure is conical and the resistance element has a conforming conical shape with the admission opening being at the end having the larger transverse cross-sectional area.

7. A resistance heater according to claim 1, wherein said power means comprises induction heating means for heating said elongated elements by inducing heating current in said mat.

8. A resistance heater according to claim 7, wherein said tubular structure is conical and the resistance element has a conforming conical shape with the admission opening being at the end having the larger transverse cross-sectional area.

9. A resistance heater for rapidly heating a fluid to a desired temperature, comprising an electric resistance element including a porous mat of fine, electricallyconductive, elongated elements connected together so as to be electrically conductive, said elongated elements being selected from the group consisting of metalcoated non-metal whiskers and polycrystalline metal whiskers, power means for supplying electric enery to said resistance element, and non-conductive tubular structure accommodating the resistance element therein so that substantially all of the fluid flows through said porous mat, said porous mat being disposed so as to substantially fill a portion of tthe length of said tubular structure, said tubular structure having at one end an opening for admission of the fluid to be heated and at the opposite end an opening for discharge of the heated fluid, wherein said elongated elements are connected at the contact points thereof by electron beam welding.

10. A resistance heater according to claim 9, wherein said elongated elements consist of metalized monocrystalline whiskers of aluminum oxide.

11. A resistance heater for rapidly heating a fluid to a desired temperature, comprising an electric resistance element including a porous mat of fine, electricallyconductive, elongated elements connected together so as to be electrically conductive, said elongated elements being selected from the group consisting of metal-coated non-metal whiskers and polycrystalline metal whiskers, power means for supplying electric energy to said resistance element, and a non-conductive tubular structure accommodating the resistance element therein so that substantially all of the fluid flows through said porous mat, said porous mat being disposed so as to substantially fill a portion of the length of said tubular structure, said tubular structure having at one end an opening for admission of the fluid to be heated and at the opposite end an opening for discharge of the heated fluid, wherein said tubular structure is conical and the resistance element has a conforming concical shape with the admission opening being at the end having the larger transverse cross-sectional area, wherein said elongated elements are connected at the contact points thereof by electron beam welding.

12. A resistance heater for rapidly heating a fluid to a desired temperature, comprising an electric resistance element including a porous mat of fine, electrically-conductive, elongated elements connected together so as to be electrically conductive, said elongated elements being selected from the group consisting of metal-coated non-metal whiskers and polycrystalline metal whiskers, power means for supplying electric energy to said resistance element, and a non-conductive tubular structure accommodating the resistance element therein so that substantially all of the fluid flows through said porous mat, said porous mat being disposed so as to substantially fill a portion of the length of said tubular structure, said tubular structure having at one end an opening for admission of the fluid to be heated and at the opposite end an opening for discharge of the heated fluid, wherein said tubular structure is conical and the resistance element has a conforming conical shape with the admission opening being at the end having the larger transverse cross-sectional area, wherein said mat is securely connected at the inner wall of said tubular structure, and wherein said elongated elements are connected at the contact points thereof by electron beam welding.

13. A resistance heater for rapidly heating a fluid to a desired temperature, comprising an electric resistance element including a porous mat of fine, electricallyconductive, elongated elements connected together so as to be electrically conductive, said elongated elements being selected from the groups consisting of metal-coated non-metal whiskers and polycrystalline metal whiskers, power means for supplying electric energy to said resistance element, and a non-conductive tubular structure accommodating the resistance element therein so that substantially all of the fluid flows through said porous mat, said porous mat being disposed so as to substantially fill a portion of the length of said tubular structure, said tubular structure having at one end an opening for admission of the fluid to be heated and at the opposite end an opening for discharge of the heated fluid, wherein said power means comprises means for directly supplying current to said mat and includes electrode means electrically connected to the mat, wherein said tubular structure is conical and the resistance element has a conforming conical shape with the admission opening being at the end having the larger transverse cross-sectional area, and wherein said elongated elements are connected at the contact points thereof by electron beam welding.

14. A resistance heater for rapidly heating a fluid to a desired temperature, comprising an electric resistance element including a porous mat of fine, electrically-conductive, elongated elements connected together so as to be electrically conductive, said elongated elements being selected from the group consisting of metalcoated non-metal whiskers and polycrystalline metal whiskers, power means for supplying electric energy to said resistance element, and a non-conductive tubular structure accommodating the resistance element therein so that substantially all of the fluid flows through said porous mat, said porous mat being disposed so as to substantially fill a portion of the length of said tubular structure, said tubular structure having at one end an opening for admission of the fluid to be heated and at the opposite end an opening for discharge of the heated fluid, wherein said elongated elements are provided with a layer of electrically-insulating material selected from the group consisting of insulating of insulated lacquers, plastics annd oxides.

15. A resistance heater for rapidly heating a fluid to a desired temperature, comprising an electric resistance element including a porous mat of fine, electrically-conductive, elongated elements connected together so as to be electrically conductive, said elongated elements being metal-coated non-metal whisers, power means for supplying electric energy to said resistance elements, and a non-conductive tubular structure accommodating the resistance element therein so that substanatially all of the fluid flows through said porous mat, said porous mat being disposed so as to substantially fill a portion of the length of said tubular structure, said tubular structure having at one end an opening for admission of the fluid to be heated and at the opposite end an opening for discharge of the heated fluid.

* * * * *